US008678697B2

(12) United States Patent
Monaghan et al.

(10) Patent No.: US 8,678,697 B2
(45) Date of Patent: Mar. 25, 2014

(54) COUPLERS AND VEHICLES PROVIDED WITH COUPLERS

(76) Inventors: Conor Monaghan, Cookstown (GB); Martin Monaghan, Cookstown (GB)

( * ) Notice: Subject to any disclaimer, the term of this patent is extended or adjusted under 35 U.S.C. 154(b) by 831 days.

(21) Appl. No.: 12/738,609

(22) PCT Filed: Oct. 15, 2008

(86) PCT No.: PCT/GB2008/003478
§ 371 (c)(1),
(2), (4) Date: Jun. 15, 2010

(87) PCT Pub. No.: WO2009/050445
PCT Pub. Date: Apr. 23, 2009

(65) Prior Publication Data

US 2010/0247228 A1 Sep. 30, 2010

(30) Foreign Application Priority Data

| | | |
|---|---|---|
| Oct. 18, 2007 | (GB) | 0720413.4 |
| Dec. 5, 2007 | (GB) | 0723746.4 |
| May 2, 2008 | (GB) | 0808035.0 |
| Jun. 20, 2008 | (GB) | 0811314.4 |

(51) Int. Cl.
*B25G 3/18* (2006.01)

(52) U.S. Cl.
USPC ..... 403/322.3; 37/468; 414/723

(58) Field of Classification Search
USPC ..... 403/322.3; 37/468; 414/723
See application file for complete search history.

(56) References Cited

U.S. PATENT DOCUMENTS

| | | | | |
|---|---|---|---|---|
| 4,881,867 | A * | 11/1989 | Essex et al. | 414/723 |
| 5,324,162 | A | 6/1994 | Kishi | |
| 5,465,513 | A * | 11/1995 | Sonerud | 37/468 |
| 5,692,325 | A | 12/1997 | Kuzutani | |
| 6,233,852 | B1 * | 5/2001 | Pemberton | 37/468 |
| 6,422,805 | B1 * | 7/2002 | Miller | 414/723 |
| 6,431,785 | B1 | 8/2002 | Melander | |
| 6,691,438 | B2 * | 2/2004 | Fatemi | 37/468 |
| 6,964,122 | B2 * | 11/2005 | Cunningham et al. | 37/468 |
| 7,004,712 | B2 * | 2/2006 | Martin | 414/723 |
| 7,032,335 | B2 * | 4/2006 | Short | 37/468 |

(Continued)

FOREIGN PATENT DOCUMENTS

| | | |
|---|---|---|
| AT | 2322 | 8/1998 |
| EP | 0506604 | 9/1992 |

(Continued)

OTHER PUBLICATIONS

PCT International Search Report PCT/GB2008/003478; 20 pages, dated Oct. 18, 2007.

*Primary Examiner* — Victor MacArthur
(74) *Attorney, Agent, or Firm* — Baker Botts L.L.P.

(57) ABSTRACT

The present invention provides a coupler (201), use of the coupler (201), and a utility vehicle having the coupler (201), the coupler (201) having a body portion and a linearly movable rail (235), arranged to be moved by an actuator, the body portion comprising an open jaw (207) arranged to receive a mounting formation of a tool, the rail having a first position in which the rail (235) is retracted relative to the open jaw (207) and in which a mounting formation can enter a recess defined by the jaw (207) and an advanced position in which the rail (235) restricts the opening to the jaw (207), thereby arranged to trap, in use, the mounting formation in the recess.

16 Claims, 10 Drawing Sheets

(56) References Cited

U.S. PATENT DOCUMENTS

| | | | | |
|---|---|---|---|---|
| 7,426,796 | B2 * | 9/2008 | Cunningham et al. | 37/468 |
| 7,984,576 | B2 * | 7/2011 | Miller et al. | 37/468 |
| 8,006,415 | B2 * | 8/2011 | Short | 37/468 |
| 8,151,494 | B2 * | 4/2012 | Scheib et al. | 37/468 |
| 8,262,310 | B2 * | 9/2012 | Sikorski et al. | 403/322.3 |
| 2002/0071754 | A1 * | 6/2002 | Fatemi | 414/723 |
| 2002/0157286 | A1 | 10/2002 | Fatemi | |
| 2004/0057784 | A1 * | 3/2004 | Geraghty | 403/322.3 |
| 2006/0070270 | A1 * | 4/2006 | Short | 37/468 |
| 2010/0129145 | A1 * | 5/2010 | Short | 403/316 |

FOREIGN PATENT DOCUMENTS

| | | | |
|---|---|---|---|
| FR | 2747137 | | 10/1997 |
| GB | 2446485 | | 8/2008 |
| KR | 2003030432 | A * | 4/2003 |
| WO | WO 00/70155 | | 5/2000 |
| WO | WO 2004038110 | | 5/2004 |
| WO | WO 2006/083172 | | 1/2006 |
| WO | WO 2007/038960 | | 4/2007 |

* cited by examiner

COUPLERS AND VEHICLES PROVIDED WITH COUPLERS

CROSS REFERENCED TO RELATED APPLICATIONS

This application claims priority to PCT/GB2008/003478 filed Oct. 15, 2008 which claims priority to Great Britain Application No. 0720413.4 filed Oct. 18, 2007; Great Britain Application No. 0723746.4 filed Dec. 5, 2007; Great Britain Application No. 0808035.0 filed May 2, 2008; and Great Britain Application No. 0811314.4 filed Jun. 20, 2008, all of which are incorporated herein by reference.

TECHNICAL FIELD OF THE INVENTION

This invention relates to the field of couplers, in particular, but by no means limited to, hydraulic couplers, a method of manufacturing a coupler, and use of a coupler, and to vehicles provided with a coupler.

BACKGROUND OF THE INVENTION

Couplers can include manual couplers, semi-automatic couplers, and automatic couplers. In particular, there are two main types of coupler used in mechanical "JCB-type" excavators or diggers to couple a digging bucket to a bucket lifting arm:—safety pin types and self-coupling automatic couplers. Couplers are typically hydraulically operated and powered.

Couplers are typically used to connect a tool, such as a digging bucket, to an arm of a utility vehicle for moving and manipulating the tool. Such, arms are often used for lifting. A typical utility vehicle, such as an excavator/digger, which would use a coupler, may have wheels and tyres or tracks, or it may run on rails.

Safety pin type couplers have a disadvantage that is discussed in the following scenario. The operator of a hydraulic digging machine sits in a weatherproof cab and uses the hydraulic arm to dig with a bucket coupled to the end of the arm. If they want to change the bucket for a different bucket or tool they need to get out of the cab, into the cold and rain, pull out the safety pin, get back into the cab and operate the hydraulic arm to de-couple the existing bucket, move the hydraulic arm to an alternative bucket, operate the hydraulic mechanism to couple to the alternative bucket, get out of the cab back into the rain and cold and push through the mechanical safety pin in the-coupling. Then they would have to get back into the cab and use the new bucket.

It has been known for there to be fatal accidents due to the operator of the digger not wanting to spend the time and trouble, and possible discomfort, of getting out of the cab to remove and replace the safety pin. Sometimes users operate the hydraulic digging arm with no safety pin in place. The bucket may stay on the end of the hydraulic arm so long as hydraulic power is still provided. However, if the hydraulic power is impaired, or ceases altogether, the hydraulic fastening of the coupling to the mounting pins on the bucket can become loose, and if there is no safety pin in place the bucket can fall off the arm. It has been known to kill people.

For that reason some people prefer to work with automatic self-locking couplers.

Existing automatic self-locking couplers are known. Examples can be found in the patent publications—U.S. Pat. No. 5,082,389 and U.S. Pat. No. 6,922,926. One type of automatic hydraulic coupler that is known uses a pendulum, or a weighted pivot point, to prevent movement of a hydraulic piston in a "release" direction in the event of failure of hydraulic pressure. It is necessary to angle the arm/bucket to a selected angle of inclination in order to release a coupler that is gravity-biased. Also, these kind of coupler systems use springs to bias components into position. A problem with these couplers is that they are mechanically complex, and there are things that can go wrong. For example, it is possible for cement to form on the springs, or stones to get into the space where a pendulum needs to operate—i.e. components can become jammed and unusable or unreliable. Diggers are, after all, used in rough environments where stones, dirt and concrete exist. Another known hydraulic automatic self-coupling coupler uses a hydraulic ram and an L-shaped pivotable finger to hold a mounting pin in a U-shaped recess. The L-shaped finger pivots down over the previously open mouth of the shaped recess. This coupler has complex pivoting components, capable of being blocked/jammed and not operating properly.

An example of such a device is described in U.S. Pat. No. 5,082,389, which describes a coupler with a spring-biased L-shaped closure member. The coupler has a pair of mutually orientated connective elements, which comprise recesses in the body of the connector. The connective elements are arranged to mount a mounting pin on a tool. The first recess opens substantially downwards and the second recess opens in a direction substantially at right angles to the direction of the opening of the first recess. The first recess has a mouth which is substantially closeable. by the spring biased L-shaped closure member. The closure member is pivoted to an open position by action of a hydraulic piston and cylinder assembly which pivots the closure member away from the mouth of the first recess; a spring returns the L-shaped closure member back to the closed mouth position. Such a device has a disadvantage that the L-shaped closure member is generally weak at retaining the mounting pin of the tool. If the spring or the hydraulic piston and cylinder assembly fails, the closure member may not operate properly and could open under pressure from the mounting pin. This connector also has a disadvantage that it is complex with several moving components which can become clogged with rocks, dirt and cement.

SUMMARY OF THE INVENTION

According to a first aspect of the present invention, there is provided a coupler having a body portion and a linearly movable rail, arranged to be moved by an actuator, the body portion comprising an open jaw arranged to receive a mounting formation of a tool, the rail having a first position in which the rail is retracted relative to the open jaw and in which a mounting-formation can enter a recess defined by the jaw, and an advanced position in which the rail restricts the opening to the jaw, thereby arranged to trap, in use, the mounting formation in the recess.

It will be appreciated that in the above invention the rail has an advanced position, which is a locking position in which the rail projects beyond the mounting formation (for example a mounting pin) and in which the rail narrows the opening of the jaw so as to trap the mounting pin/formation.

The fact that there is only one moving component, and it moves linearly rather than arcuately, gives the design an elegance and a strength, that is not present in the prior art. It has fewer moving components.

Furthermore, in many embodiments the coupler can be made in two separate components fastened together by only two mounting pins. The components of the coupler may be cast. This is a particularly cheap way of manufacturing a coupler.

Reference herein to 'vehicle' is intended to refer to a carrier, such as a mode of transport or a platform which is either moveable or stationary. For example, the vehicle may be a locomotive. The vehicle may be a stationary fixed platform. The vehicle may be diggert/excavator or similar utility vehicle.

According to another aspect of the invention we provide a springless and detentless coupler in which an actuator moves a retaining rail forwards and backwards linearly in order to open a mounting formation-receiving aperture and trap a mounting formation in said aperture.

The actuator may be a hydraulic piston and cylinder assembly, or other suitable actuating mechanism (for example pneumatic, electrical, or mechanical).

The tool, which is intended to be mounted to the coupler, may be selected from any of the group comprising an excavator bucket, backhoe bucket, ripper bucket, shaker bucket, V-ditch digging bucket, telehandler bucket, hydraulic hammer, auger drive unit, hydraulic post driver, pile cropper, sheet pile driver, waste grapple, concrete pulveriser, land clearance rake, backfill blade, ripper hook, demolition grapple, shears and grabs, or any other suitable tool.

The shape of the aperture or opening in the jaw may be defined, at least in part, by a lip. The lip or inside of the jaw may comprise an inclined surface disposed generally opposite to a reaction surface of the rail, or may comprise a curved surface. Preferably, in an embodiment where the opening in the jaw is define by a lip, there is no opposing lip. The jaw may have no lip or lips. The reaction surface of the rail is that part of the rail that contacts the mounting formation when the mounting formation presses, in use, against the rail. The inclined surface may be inclined towards the reaction surface of the rail. The lip or end of the jaw may reduce the width of the aperture or opening of the jaw in comparison with an enlarged recess defined rearwards of the lip or end of the jaw. When the rail is in the extended/advanced position, the Shortest distance between the reaction surface of the rail and the lip or end of the jaw may be less than the diameter of the mounting pin/formation.

The end of the jaw may be chamfered. Preferably the end of the jaw provides a chamfered lead into the opening defined by the jaw. The end of the jaw may comprise a guide surface, which, in use, guides a mounting formation into the opening/mouth defined by the jaw. The guide surface preferably directs the mounting formation into the mouth/opening. The guide surface may have an angled or sloping portion, positioned in a region at the end of the jaw and a substantially flat portion that is substantially parallel to the rail. The end of the jaw may comprise a substantially flat surface which is angled away from the reaction surface of the rail.

The chamfered lead into the mouth/opening defined by the jaw has the benefit that it prevents jamming during loading of a mounting formation into the mouth/opening of the jaw. The guide surface advantageously guides the mounting formation into the mouth/opening defined by the jaw when loading the mounting formation into the jaw of the coupler.

The aperture, recess or opening in, the jaw may be shaped such that a back/rear wall of the jaw may be inclined or curved towards the reaction surface of the rail. This feature ensures that the inclined or curved surface of the rear wall of the jaw biases, in use, the mounting formation towards the rail when the mounting formation is forced by gravity towards the rear of the coupler. This prevents the rail dropping/retracting back into the first position of the coupler upon hydraulic failure, through the action of friction on the rail.

An advantageous feature of many aspects or embodiments of the invention is that the shape of the aperture/opening in the jaw of the coupling, into which the mounting pin of the tool is received, is shaped so as to cause gravity to bias the mounting pin. against the rail laterally of the rail, thereby tending to pinch the rail against reaction surfaces of the coupler, hindering the rail from sliding even when hydraulic power is removed from the hydraulic ram.

The reaction surface of the rail may be substantially planar. The reaction surface of the rail may be substantially flat. The reaction surface of the rail may be on the face of the rail that faces the lip and/or jaw. The reaction surface of the rail, intended to contact and retain the mounting pin, may be substantially parallel to the linear movement of the rail.

Preferably the reaction surface of the rail is not part of a surface-of a hook or projection that projects from the rail.

The rail may be substantially planar. The rail may be a substantially flat plate or rod. The rail may span part of, or substantially the whole lateral width of the jaw. The rail may not have, in some embodiments, a hook or projection which projects further from the rail in a direction across or partially across the opening of the jaw and intended to retain the mounting pin in the recess of the jaw. The rail is preferably a straight, unbent, linear member. In an alternative embodiment, the rail may comprise a safety hook. The safety hook may be positioned at the end of the rail adjacent the jaw. The safety hook may prevent disengagement of the mounting formation/pin from. the coupler when the rail is in a retracted position relative to the jaw.

The safety hook has an advantage of making the coupler easier to use, for example by a less experienced operator. It also increases safety, for example, if the jaw does not retain the mounting formation/pin properly due to misuse of the coupler, the safety hook will still prevent release of the mounting formation/pin from the coupler.

The safety hook may-be shaped to prevent retention of the mounting formation by the safety hook when the mounting formation is being released from the coupler. The safety hook may comprise a trough portion in the end region of the safety hook. The safety hook may comprise a trough portion in an inner concave surface of the safety hook. The trough portion may be a depression in the inner concave surface of the safety hook. Preferably the trough portion provides a geometry of the inside surface of the safety hook such that, in use, a mounting formation, 30 pushing against the safety hook through the force of gravity, is discouraged from settling or being trapped in the inside concave surface of the safety hook. Preferably the trough portion encourages release of the mounting formation when the coupler is in a vertical position, i.e. when the linear rail is in a vertical position relative to the ground. Preferably when the mounting formation is engaged within the inner concave surface of the safety hook, the central rotational axis of the mounting formation is arranged to be aligned with the trough portion, or aligned beyond the trough portion towards or beyond the end of the safety hook. The end of the safety hook may comprise an end portion, which is positioned beyond the trough portion towards the end of the safety hook. The end portion may be a ridge defined by the end of the safety hook and the trough portion. The trough portion—advantageously encourages release of the mounting formation from the coupler by preventing the mounting formation from being retained by the safety hook when the coupler is in a vertical position and the rail is in a position to release the mounting formation. The end portion of the safety hook has a benefit of encouraging a positive connection of the safety hook to the mounting formation during pickup/loading of the mounting formation.

Preferably, when the rail is in the first position, where the rail is retracted relative to the jaw, the distance between the end of the safety hook, is less than the width of the mounting formation/pin, This has an advantage that in. use, in the event of a missed engagement of the mounting formation/pin in the jaw, the safety hook still prevents untimely release of the mounting formation/pin from the coupler.

Preferably when the rail is in the second, advanced position relative to the jaw, the gap between the end of the safety hook and the jaw is wide enough to accommodate a mounting formation/pin.

This has a benefit of allowing engagement or release of a mounting formation/pin from the coupler when required.

A hook recess may be provided between the end of the rail and the safety hook, which, when aligned opposite the jaw, provides a gap between the end of the jaw or lip and the rail, which is wide enough to allow a mounting formation/pin into the jaw. Preferably when the hook recess is not aligned opposite the jaw, the gap between the rail and the end of the jaw or lip is not wide enough to allow access of a mounting formation/pin into or out of the jaw.

Preferably, in use, the rail is arranged to be maintained in position, when force is applied to the rail from the mounting formation/pin, by friction between the rail and a coupler reaction surface on the coupler and/or a rail guide. The coupler reaction surface may comprise a rail guide or support. The coupler reaction surface may be part of a front wall of the body portion, or part of the jaw opposite the lip.

The jaw may comprise a forward jaw of the body portion. The rail may comprise a second/rear jaw for engaging a second mounting formation or pin of the tool. Preferably the rear jaw defines a recess provided with an opening. The opening of the rear jaw may face in substantially the opposite direction to that of the opening of the forward jaw. The forward jaw and rear jaw may be linearly aligned.

It will be appreciated that the terms "forward" and "rear" used in conjunction with "jaw" can be used interchangeably.

The rail may comprise a safety indication. The indication may be located at an end region of the rail. The indication may be a colour of the whole rail portion or part of the rail portion. For example the rail may be coloured red or some other bright, easy to see, colour. The indication may be a word or symbol on the rail, or some other visual indication. The rail may be a different colour to the body portion of the coupler. The indication may become visible to an operator on the ground near the coupler only when the rail is in the advanced position of the coupler.

An advantage of providing the indication on the rail is that the operator can see (e.g. from the cab or by standing next to the coupler outside the cab) that the rail is in the advanced position relative to the body portion of the coupler, indicating that the coupler is correctly and safely attached and locked to the tool.

The coupler may comprise rail guides. Preferably the body portion comprises rail guides for slidable engaging the rail. The rail guides may also comprise reaction surfaces to prevent lateral and/or vertical and/or non-linear movement of the rail. The rail guides may support the rail. The rail guides may flank the rail. Preferably rail guides support the rail at a position on the opposite side of the rail to the reaction surface (mounting-formation engaging surface) of the rail.

The rail guides may be arranged to clean the rail from excess debris or dirt. The rail guides may be arranged to sweep the rail.

Rail guides can have an advantage (with the rail being a sliding fit between guides) that the rail assembly can be self-cleaned when the rail is retracted to the position which opens the jaw so that it is ready to receive the mounting pin.

The coupler may comprise an arm-mounting yoke. The arm-mounting yoke may be provided by flanges or plates extending from sidewalls of the coupler. The arm-mounting yoke may comprise mounting holes for mounting the coupler on the arm of a utility vehicle.

A feature of many embodiments of the invention is that by using a linearly slidable rail, without the need for pendulums, springs or detents, which pivot away from the central axis of the rail, taking up space when they pivot, arm-mounting holes of the arm-mounting yoke can be closer to the mounting pins of the tool. This can be a benefit when used with a bucket tool because it can give a larger ground penetration force of the front, cutting, edge of the bucket where it engages with the ground. It reduces the length of "lever" forces that need to be conveyed across the coupling, thereby enabling more force to be applied in a ground-breaking direction by the bucket. For example, depending upon the size of the coupling unit itself, the coupler of the present invention can achieve perhaps 10% more ground penetration force. A thirteen tonne coupler can take the distance between the axis of the centres of the arm-coupling holes and the axis of the mounting pins on the bucket down from about 270 mm to about 220 mm—a reduction of 50 mm or so.

For a twenty tonne coupler the distance may be reduced by about 150 mm. For a thirty tonne coupler the distance may be reduced by about 200 25 mm.

A further advantage of many embodiments is that by reducing the distance between the arm-mounting holes of the arm-mounting yoke and the mounting pins of the tool, the physical amount of metal in the coupling can be reduced. 60-70 kilograms of weight can be saved for a typical thirteen tonne coupler (typically made in steel). This has an advantage when the user uses the coupler and tool on an arm primarily to lift things (for example many users who use lifting arms and buckets on rail tracks use them primarily to lift things). An extra b0-70 kilograms lifting power may be achieved. Typically care is taken to design lifting arms with reduced weight, but presently little care is taken to design couplers with reduced weight.

It will be appreciated that labour expense is an important component of manufacturing couplers. In the prior art that have three pieces (at least) and a hydraulic piston and cylinder assembly, though typically at least three mounting pins hold the multiple pieces together. The coupler according to many embodiments of the present invention is simpler and requires only two separate components (plus the hydraulic piston and cylinder assembly) held together by two pins, It is springless, and does not have pendulums (pendulumless), has no parts moving in arcs, etc.

According to another aspect of the invention there is provided a coupler adapted to couple a mounting pin or mounting formation oϵ bucket or tool to a lifting arm (for example, of earth moving equipment), the coupler comprising a jaw-defining member which defines a generally U-shaped mouth into which the mounting pin/formation is received in use, and a linearly moveable rail which has a retracted position in which the mouth of the jaw is unobstructed to the extent that a mounting pin/formation can enter the jaw and an advanced position in which the rail projects forward to at least a forward position of the mouth of the jaw, reducing the cross-sectional space at the mouth of the jaw, thereby retaining a mounting pin/formation disposed within the jaw.

According to another aspect of the invention there is provided a coupler comprising a hydraulic piston and cylinder assembly and a single moving part arrange to move forwards and backwards by the hydraulic piston and cylinder assembly.

The simplicity of such a coupler has great technical and safety advantages.

The coupler may comprise a body defining a forward jaw adapted to receive a mounting pin/formation of a tool and a rear jaw mounted on the body, the rear jaw being movable relative to the forward jaw by a piston and cylinder assembly which is adapted to move a rail linearly forwards and backwards to reduce and increase the distance between the front and rear jaws.

A reaction surface may be provided on the rail, forwards of the front part of the forward jaw so as to serve to provide reaction force laterally of the rail when the rail is in an advanced position, projecting beyond the opening at the front of the forwards jaw.

A reaction surface may be provided rearward of the U-shaped mouth of the forward jaw in order to provide lateral reaction force against the rail.

Preferably a reaction surface is provided both immediately behind and immediately in front of the jaw so as to brace the rail against lateral movement perpendicular to the direction of travel of the rail should force be applied to the rail laterally by the mounting pin/formation of the tool.

According to another aspect of the invention, there is provided a utility vehicle comprising an arm for a tool, wherein a coupler according to the invention is mounted on the arm.

The utility vehicle may be an excavator/digger.

According to a further aspect of the invention, there is provided a method of manufacturing a coupler for a utility vehicle, comprising the steps of, Casting or moulding a body portion;

making, preferably casting or moulding, a rail portion; slidably engaging the rail portion with the body portion; and mechanically linking the rail portion and body portion with a hydraulic piston and cylinder system.

The method of manufacture may further comprise the step of securing the rail portion to the body portion, for example using a pin.

According to a further aspect of the invention, there is provided a method of manufacturing a coupler according to the invention, comprising the steps of, casting or moulding a body portion comprising a jaw;

making, preferably casting or moulding, a rail portion comprising a rail;

slidably engaging the rail portion with the body portion; and mechanically linking the rail portion and body portion with a hydraulic piston and cylinder system.

According to a yet further aspect of the invention, there is provided the use of a coupler according to the invention.

In an embodiment where the coupler comprises the safety hook, it is preferable that the coupler is used by hooking the safety hook onto a mounting formation/pin before engaging the mounting formation/pin with the jaw.

The skilled man will appreciate that all preferred or optional features of the invention described with reference to only some aspect of embodiments of the invention may be applied to all aspect of the invention.

It will be appreciated that optional features applicable to one aspect of the invention can be used in any combination, and in any number. Moreover, they can also be used with any of the other aspects of the invention in any combination and in any number. This includes, but is not limited to, the dependent claims from any claim being used as dependent claims for any other claim in the claims of this application.

BRIEF DESCRIPTION OF THE DRAWINGS

An embodiment of the present invention will now be described herein, by way of example only, with reference to the following figures.

DETAILED DESCRIPTION OF THE INVENTION

Figure 1:
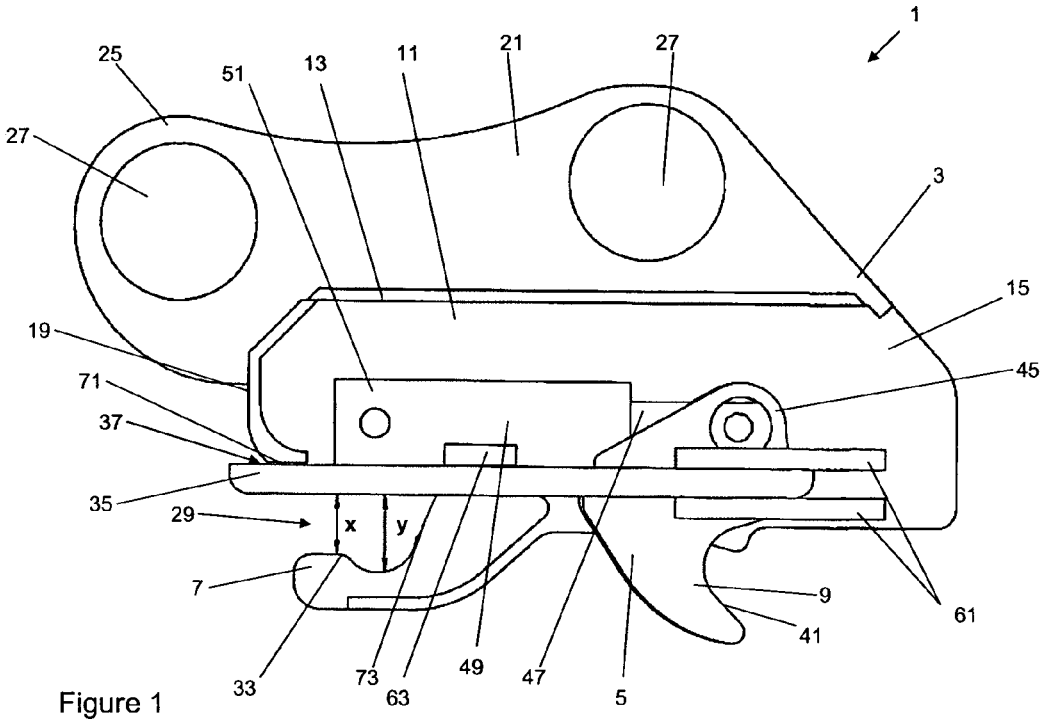
FIG. 1 illustrates a cross-sectional side view of a coupler according to an embodiment of the invention.

With reference to FIGS. 1-6, a coupler 1 according to the invention comprises a body portion 3 slidably engaged with a rail portion 5. The body portion 3 defines a forward jaw 7 and the rail portion 5 defines a second/rear jaw 9 which has an opening facing in the opposite direction to-the forward jaw 7 of the body portion 5. In this embodiment, the rail portion 5 is coloured in red as an indication, and the body portion 3 is coloured blue, to assist the user in determining the relative positions of the body portion 3 and the rail portion 5. However, it is understood that any suitable colours, words, symbols, or other indications may be used.

The body portion 3 comprises an enclosure 11 (best shown in FIGS. 1 and 4), arranged to accommodate the rail portion 5. The body portion 3 has a substantially flat roof 13 extending perpendicularly between two parallel sidewalls 15, 17, and a front wall 19. A pair of parallel plates 21, 23 are mounted to the opposing sidewalls 15, 17 and extend perpendicularly beyond the roof 13 to provide an arm-mounting yoke 25 (see FIG. 3). In an alternative embodiment the sidewalls 15, 17 themselves' provide flanges (not shown) which extend perpendicularly beyond the roof 13 to form the arm-mounting yoke 25. The arm-mounting yoke 25 comprises four holes 27 for mounting the arm (not shown) of a utility vehicle, such as a digger.

The body portion 3 is cast in metal, for example cast iron, in one part. The rail portion 5 is also, in this example cast in one part from metal, such as cast iron.

The front wall 19 has a substantially S-shaped profile with a portion of the front wall 19 being recessed 29 into the forward jaw 7. The forward jaw 7 has an opening that faces towards the forward end of the coupler 1 and it is on the opposite side of the coupler 1 from the arm-mounting yoke 25. The recess 29 defined by the forward jaw 7 is shaped and sized to accommodate a first mounting pin 31 of a tool, such as a mounting pin of a bucket. The forward jaw 7 has a lip 33 which partially encloses the recess 29 defined by the forward jaw 7, such that the width of the forward jaw 7 opening is reduced towards the end of the forward jaw 7. This is illustrated by points 'x' and 'y' on FIG. 1—the distance 'x' between the lip 33 of the forward jaw 7 and a rail 35 of the rail portion 5 is shorter than the distance 'y' between the forward jaw 7 and the rail 35.

The lip 33 has a curved/inclined surface which, in use, under the force of gravity, biases an engaged mounting pin/formation 31 towards the rail 35, laterally of the rail 35. In one embodiment (best shown in FIG. 1), the recess 29 of the forward jaw 7 is also shaped such that a rear wall 73 of the jaw, opposite the lip 33, is inclined or curved towards the rail 35, such that, in use, under an engaged mounting pin/formation 31 under the force of gravity toward the rear of the coupler 1, biases the mounting pin/formation 31 towards the rail 35, laterally of the rail 35. Upon hydraulic failure, this prevents the rail 35 from dropping/retracting back into the first/open position of the coupler 1 through the action of friction between the mounting pin/formation 31, the rail 35, and a rail guide 63 and/or coupler reaction surface 71, thereby unobstructing the forward jaw 7 and allowing untimely release of the mounting pin/formation 31. A slot 37 is provided within the recess defined by the forward jaw 7, which is arranged to slidably engage the rail 35 of the rail portion 5. The slot 37 is substantially rectangular and substantially spans the distance between the side walls 15, 17 of the body portion.

The rail 35 is substantially rectangular in shape and is planar. The rail 35 has a reaction surface which faces the forward jaw 7 and the lip 33 when the coupler 1 is in the advanced position.

The rail portion 5 also comprises a rear jaw 41. The rear jaw 41 is formed from a pair of parallel plates, which project perpendicularly from the face of an end region of the rail 35. The parallel plates of the rear jaw 41 are substantially shaped like a shark's fin, with the rear jaw 41 defining a recess, which opens to an end of the rail portion 5. The recess defined by the rear jaw is shaped and sized to accommodate a second mounting pin 43 of a tool.

The rail portion 5 also comprises a pair of piston rod mounting plates 45, which attach the rail portion 5 to a piston rod 47 of a hydraulic piston and cylinder system 49. The piston rod mounting plates 45 perpendicularly project from the opposite face of the rail 35 relative to the rear jaw 41 and parallel relative to each other. The piston rod mounting plates 45 are substantially wedge-shaped. The cylinder 51 of the hydraulic piston and cylinder system 49 is attached to the body portion, in a region behind the front wall 19.

The rail portion 5 is slidably engaged in the enclosure 11 of the body portion 3. Movement between the body portion 3 and the rail portion 5 is linear. The rail portion 5 is operably/mechanically attached to the body portion 3 by the hydraulic piston and cylinder system 49. The forward jaw 7 and rear jaw 41 are linearly aligned and the openings of the forward jaw 7 and the rear jaw 41 open in the opposite direction relative to each other.

Figure 2A:
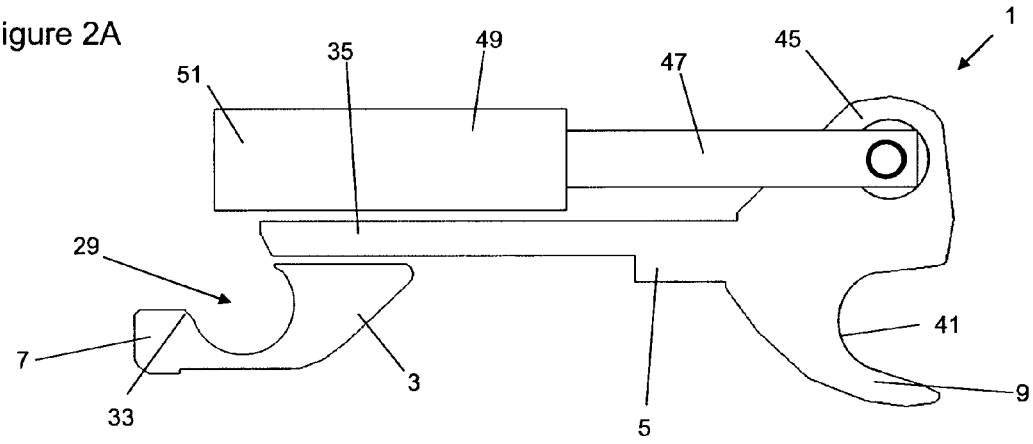
FIG. 2A shows a schematic diagram of the coupler in a first/open position.
Figure 2B:
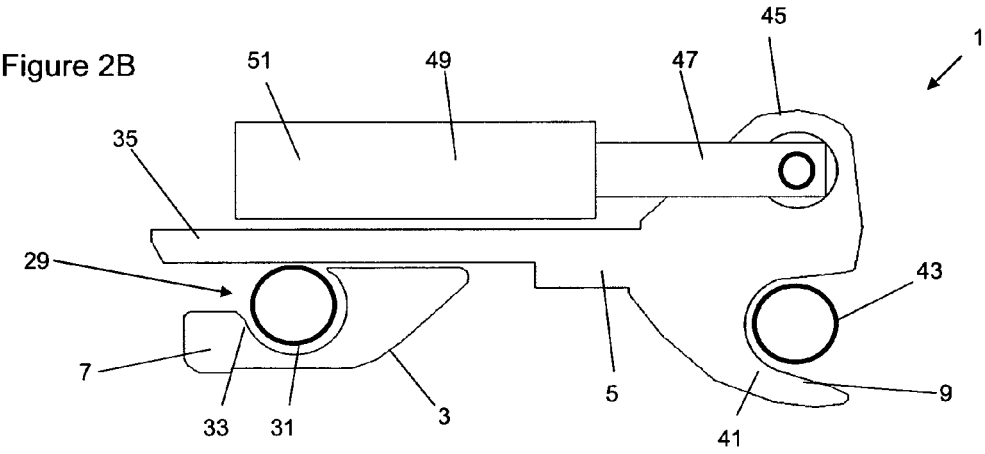
FIG. 2B shows a schematic diagram of the same coupler with the rail in an advanced position, wherein it is coupled to a pair of mounting pins.
Figure 3:
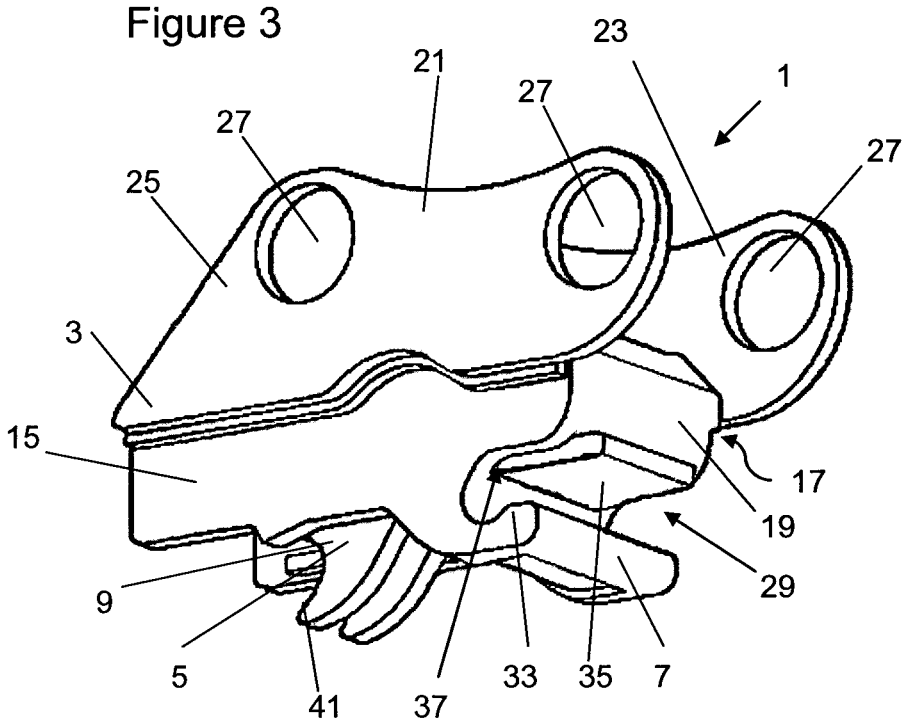
FIG. 3 shows a perspective view of the coupler of FIG. 1.

The coupler 1 has a first, retracted, position (shown in FIG. 2A) and an advanced position (shown in FIGS. 1 and 2B). The first position, shown in FIG. 2A, is where the rail 35 is retracted within the slot 37 of the forward jaw 7, and the piston rod 47 is extended, i.e. in this position the rail 35 does not substantially narrow or obstruct the width of the recess 29 defined by the lip 33 of the forward jaw 7. The advanced position, shown in FIGS. 1 and 2B, is where the rail 35 is linearly extended through the slot 37 of the forward jaw 7 up to, or beyond the lip 33 of the forward jaw 7, i.e. in this position the rail 35 substantially obstructs and narrows the width of the recess 29 defined by the lip 33 of the forward jaw 7. In the advanced position, the piston rod 47 is retracted within the cylinder 51 and the forward jaw 7 and rear jaw 41 are relatively closer together than when the coupler 1 is in the first position.

In the advanced position (shown in FIGS. 1 and 2B), where the rail 35 is linearly extended within the forward jaw 7, the forward jaw 7 is wide enough to accommodate a mounting pin 31 of a tool, but the distance between the lip 33 of the forward jaw 7 and the rail 35 is too narrow to allow passage of a mounting pin 31 out of the forward jaw 7.

Figure 4:
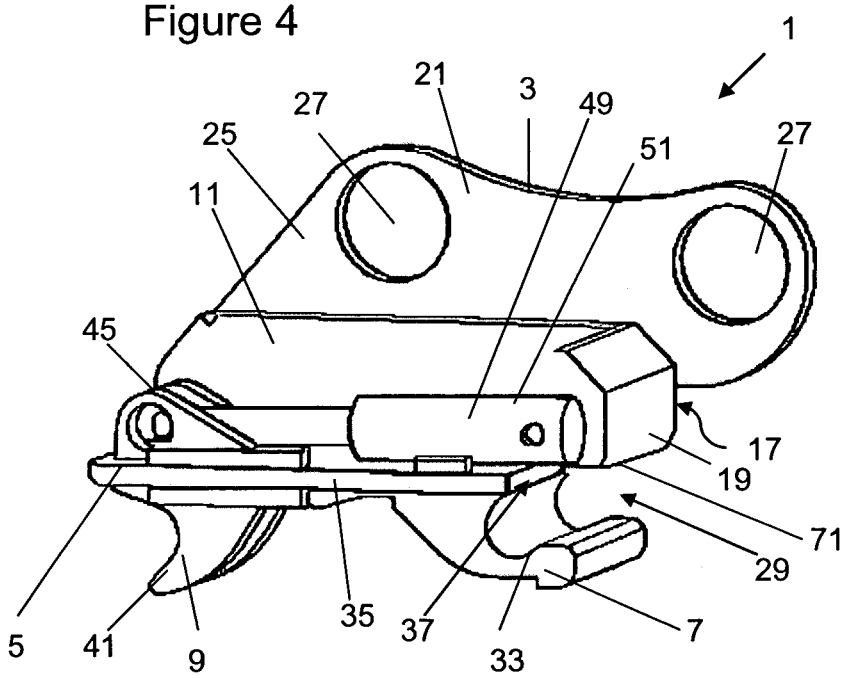
FIG. 4 shows a perspective cut-away view of a coupler with a sidewall removed revealing the internal components in the enclosure of the coupler.
Figure 5:
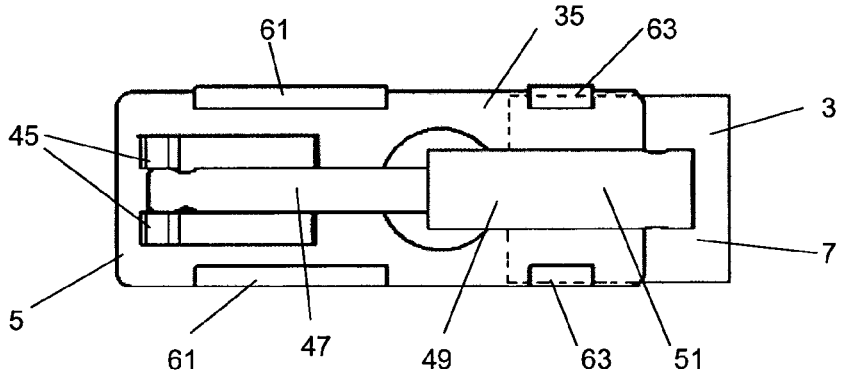
FIG. 5 shows a plan view of the rail coupled to a hydraulic piston and cylinder system.

The body portion 3 also comprises rail guides 61, 63, best shown in FIGS. 1, 4 and 5, which project from the inside face of the side walls 15, 17 of the body portion 3. The mail guides 61 furthest from the forward jaw 7 flank the rail 35 of the rail portion 5 and are arranged to slidably engage and support the rail portion 5. The rail guides 63 nearest to the forward jaw 7 are arranged to support the rail 35 from the opposite face of the rail 35 relative to the forward jaw 7, such that the rail 35 is not capable of movement in a direction away from the lip 33 of the forward jaw 7 when the rail 35 is in the advanced/extended position.

A coupler reaction surface 71 is provided on the body portion 3 and is arranged to contact the rail 35 on the opposite side from the rail reaction surface (mounting-formation contact surface). The coupler reaction surface 71 is part of the front wall 19 of the body portion 3. The coupler reaction surface 71 supports the rail 35 when, in use, lateral force is applied to the rail 35 from a mounting pin/formation 31. The coupler reaction surface 71 prevents movement of the rail 35 away from the lip 33, and prevents the rail 35 from bending. The coupler reaction surface 71 supports the rail 35 in conjunction with the forward most rail guide 63.

Figure 6:
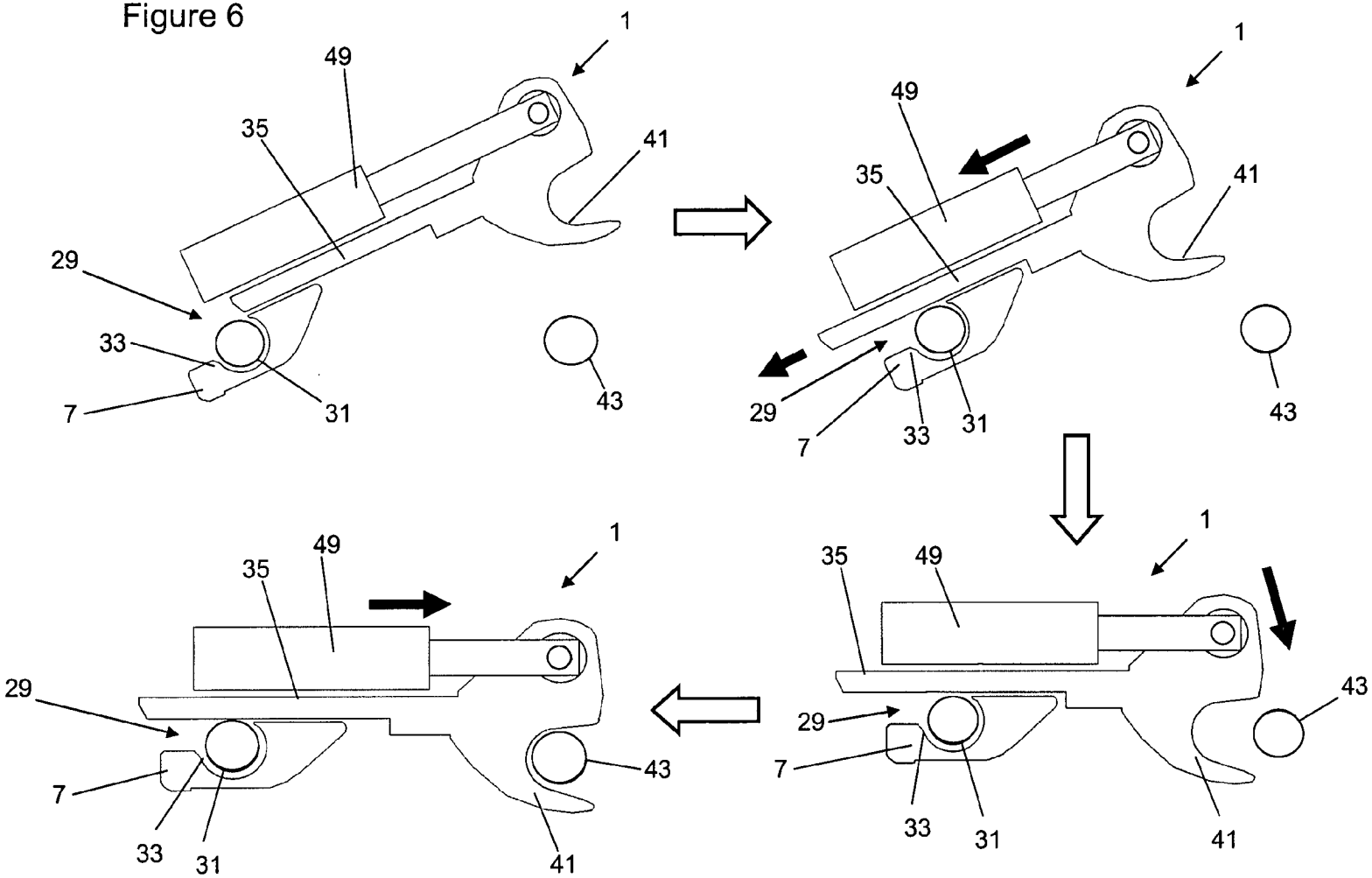
FIG. 6 shows a stepwise schematic diagram of the coupler being coupled to mounting pins of a tool.

In use, the coupler I is mounted to an arm of a vehicle, such as a digger. With particular reference to FIG. 6, the coupler 1 is first used in the first position, where the rail 35 is retracted and the forward jaw 7 can allow access to a first mounting pin 31 of a tool. The coupler 1 is lowered into a position where the first mounting pin 31 enters the recess 29 of the forward jaw 7. The rail 35 of the coupler 1 is-then moved to the advanced position by action of the hydraulic piston and cylinder system 49 which linearly slides the rail 35 to extend it through the slot (not shown) of the forward jaw 7. The extension of the rail 35 through the slot of the front jaw 7 narrows the width of the recess 29 defined by the lip 33 of the forward jaw 7, such that the first mounting pin 31 is too wide to pass out of the recess 29 defined by the forward jaw 7 and is retained. The coupler 1 is then maneuvered into a position to engage with a second mounting pin 43 on the tool. The rear jaw 41 is aligned with the second mounting pin 43 and the distance between the forward jaw 7 and the rear jaw 43 is increased, by action oϵ the piston and cylinder system 49, until the second mounting pin 43 enters a recess defined by the rear jaw 43. During the engagement of the second mounting pin 43, the rail 35 is still maintained in the advanced/extended position to retain the first mounting pin 31.

Pressure, from the front and rear jaws 7, 43, is maintained on the first and second mounting pins 31, 43 to prevent disengagement of the mounting pins 31, 43 from the coupler 1. In the event of a hydraulic 20 failure, the first mounting pin 31 is prevented from dangerously disengaging from the forward jaw 7 by the presence of the rail 35 in the advanced position. The mounting pin 31, under action of gravity is pushed against the lip 33 of the forward jaw 7 and the reaction surface of the rail 35. The rail 35, partially through friction with the rail guide 63, is incapable of moving linearly or non-linearly away from the lip 33 to allow the untimely and dangerous release of the first mounting pin 31. The rail 35 is further supported and prevented from movement away from the lip by the rail guide 63 on the opposite face of the rail 35 relative to the forward jaw 7 and first mounting pin 31.

Figure 7:
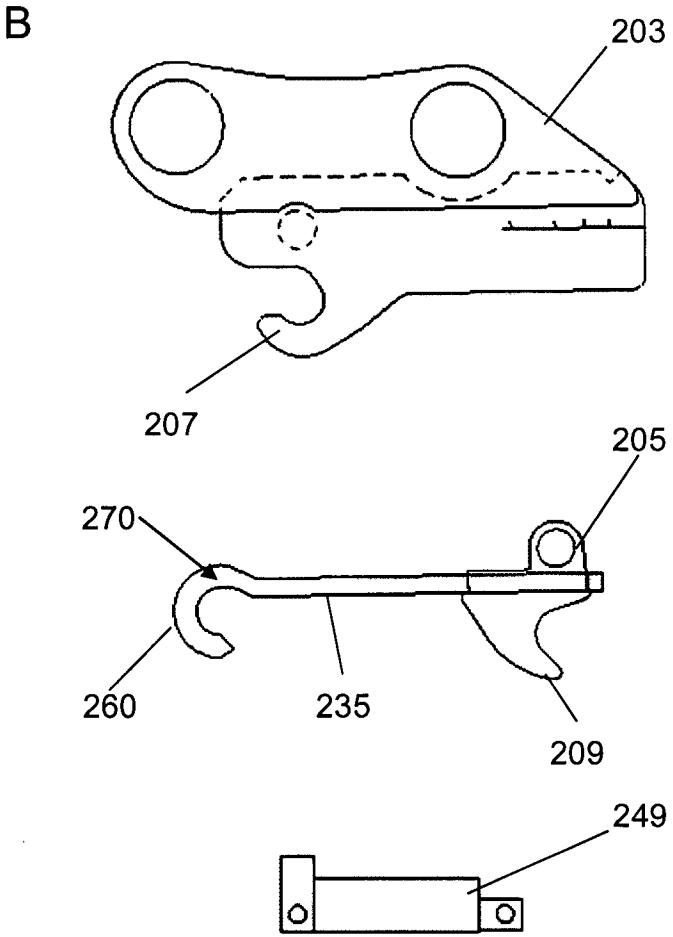
FIG. 7A shows a side view of another embodiment oϵ a coupler according to the invention.
FIG. 7B—shows the same coupler of FIG. 7A split into individual parts.
Figure 7:
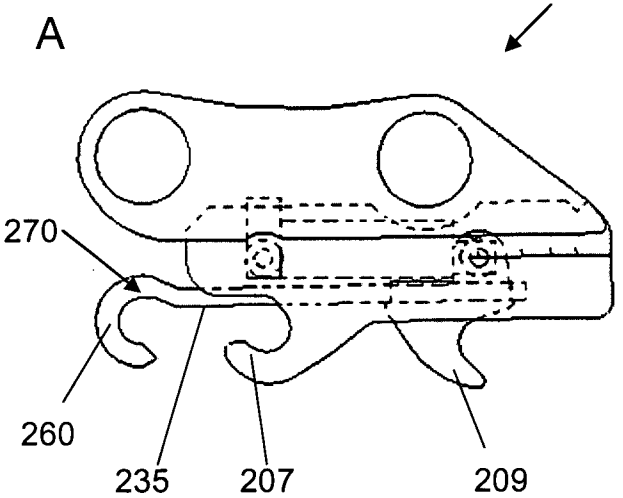

In an alternative embodiment shown in FIGS. 7A and B, FIGS. 8A-F and FIG. 9, a coupler 201 comprises an alternative rail portion 235 comprising a similar second/rear jaw 209 to the first embodiment, which has an opening facing in the opposite direction to the forward jaw 207 of the coupler 201. The rail portion 235 of this embodiment has an additional safety hook 260 extending from the end of the rail 235 adjacent the forward jaw 207. The safety hook 260 is a substantially C-shaped curved projection curling from the end of the rail portion 235 towards the forward jaw 207. The safety hook 260 turns back on itself. Best shown in FIG. 9, the safety hook 260 comprises a hook recess 270, which is provided by a recess surface 271, which, when aligned opposite the forward jaw 207, provides a gap x between the end of the forward jaw 207 and the hook recess 270 and recess surface 271, which is wide enough to allow a mounting pin 231 of a digging bucket into the forward 15 jaw 207. The inside of the forward jaw 207 is wide enough to accommodate the mounting pin 231, as the gap y between the inside portion (i.e. within the jaw mouth behind the end of the forward jaw 207) of the forward jaw 207 and the rail portion 235 is wider than the diameter of the mounting pin 231. Gap y is 18 mm to protect the coupler 201 from wear and tear. When the hook recess 270 and recess surface 271 are not aligned opposite the end of the forward jaw 207, the gap z between the rail portion 235 and the forward jaw 207 is not wide enough to allow access of a mounting pin 231 into or out of the forward jaw 207. The mounting pin 231 can only enter or exit the forward jaw 207 when the recess surface 271 is aligned with the end of the forward jaw 207.

When the rail 235 is in the first position, where the rail portion 235 is retracted relative to the forward jaw 207, the distance between the end of the safety hook 260 and the end of the forward jaw 307, is less than the width of a mounting pin of a digging bucket, such that in use, in the event of a missed engagement of the mounting pin in the rear jaw 209 and the over retraction of the rail portion 235, the safety hook 260 still prevents untimely release of the mounting pin of the digger bucket from the coupler 201. When the rail portion 235 is in a second, advanced position relative to the forward jaw 207, a gap between the end of the safety hook 260 and the forward jaw 207 is wide enough to accommodate a mounting pin—allowing engagement or release of a mounting pin: it allows the pin to enter or leave the forward jaw 207.

The forward jaw 207 of this embodiment does not provide a particularly pronounced. substantial inwardly directed projecting lip at the end of the jaw as in the first embodiment of the invention (i.e. there is a lip, but it is not an especially substantial lip on the jaw narrowing the mouth/entrance to the jaw. Instead, the end of the forward jaw 207 is spaced from the rail portion 235 to prevent access or disengagement of a mounting pin when the rail portion is in the advanced position relative to the forward jaw 207. There is no opposing lip or lips in the forward jaw 207.

In use, a user couples the coupler 201 of this embodiment to mounting pins 231, 243 of a digger bucket 280 by following a series of steps as illustrated in FIGS. 8A-F. The steps are as follows.

Figure 8:
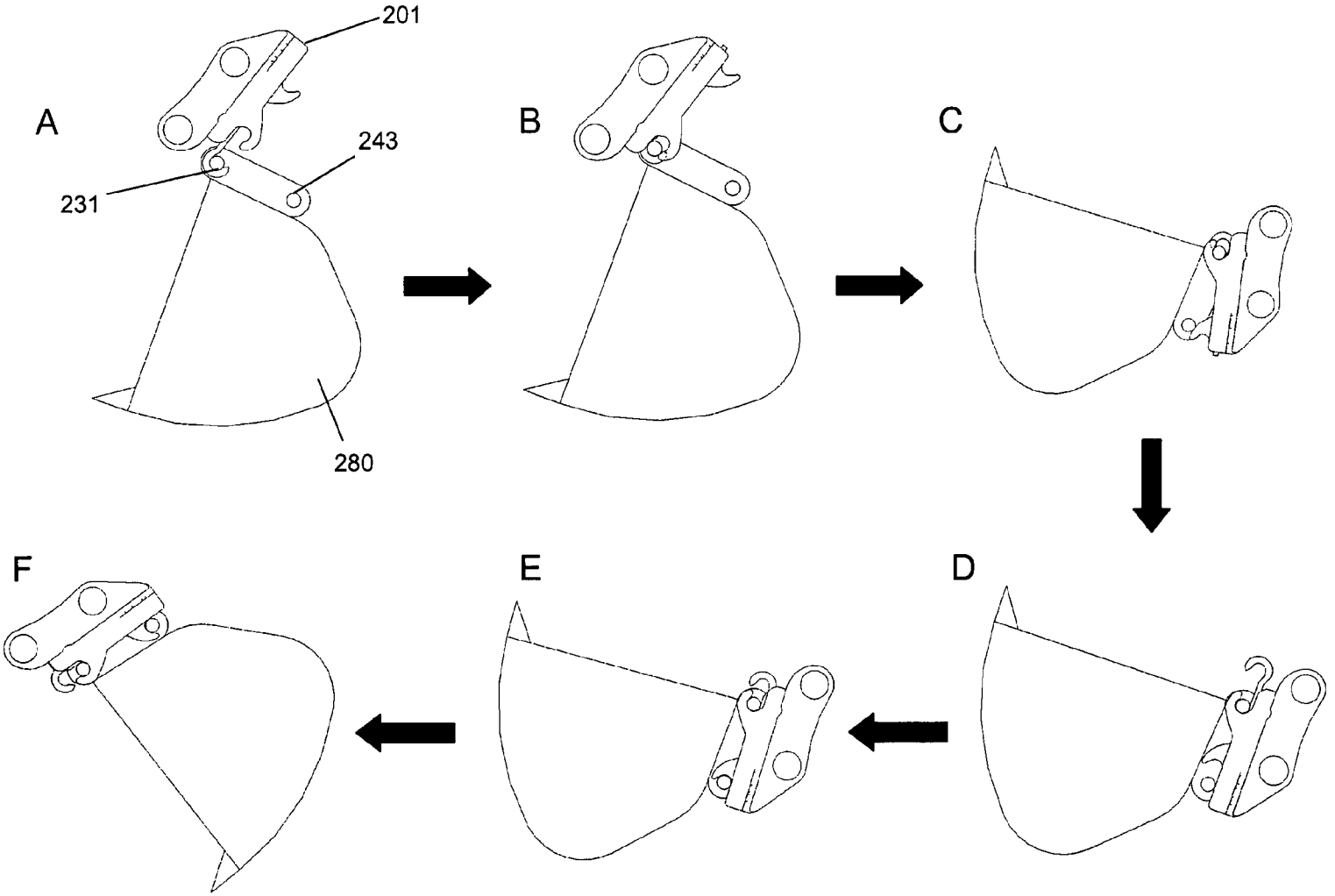
FIGS. 8A-F shows a step wise diagram of the coupler of FIGS. 7A and B as it is coupled to a digger bucket.
Figure 9:
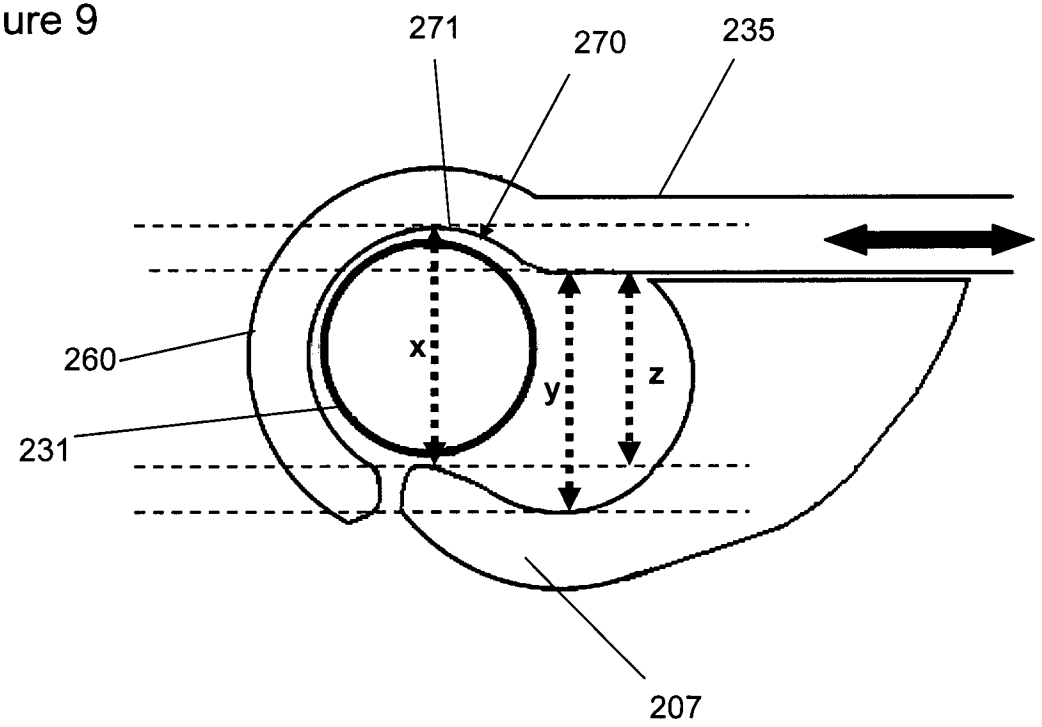
FIG. 9 shows a close up schematic diagram of the jaw and safety hook features of the coupler depicted in FIGS. 7A-B and 8A-F.

With reference to FIG. 8A the coupler is first in an advanced position where the cylinder and piston assembly is retracted and the rail portion 235 and safety hook 260 are extended/advanced from the forward jaw 207. The coupler is maneuvered (on a digger arm) such that the safety hook 260 hooks the forward mounting pin 231.

With reference to FIG. 8B, the cylinder and piston assembly is activated/extended in order to retract the rail portion 235, and safety hook 260 towards the forward jaw 207 such that the forward mounting pin 231 is brought into the forward jaw 207-access of the forward mounting pin 231 into the forward jaw 207 is allowed by the alignment of the hook recess 270 with the end of the forward jaw 207, which provides a gap large enough to accommodate the forward mounting pin 231.

With reference to FIG. 8C, the coupler 201 is. maneuvered to pull the digging bucket 280 into a position where the forward pin 207 sits at the bottom of the mouth of the forward jaw 207.

With reference to FIG. 8D, the cylinder and piston assembly is again activated/retracted to extend the rail portion 235 and safety hook 260 into the advanced position away from the forward jaw 207, thus, trapping the forward mounting pin 231 in the forward jaw 207 by the reduction in width between the rail portion 235 and the end of the forward jaw. At the same, the rear jaw 209 of the coupler 201 is retracted/moved closer towards the front jaw 207. This allows room for the rear jaw 209 to access and align with the rear mounting pin 243.

With reference to FIG. 8E, the cylinder and piston assembly is again activated/extended to increase the distance between the rear jaw 209 and the forward jaw 207, such that the rear jaw 209 engages and pushes against the rear mounting pin 243. This action also retract the rail portion 235 towards the forward jaw, but the rail portion 235 is not retracted enough relative to the forward jaw 207 to allow disengagement of the forward pin 231 from the forward jaw 207.

With reference to FIG. 8F, the mounting pins 231, 243 of the digger bucket 280 are now secured in the forward jaw 207 and rear jaw 209 of the coupler 201. The safety hook 260 prevents disengagement of the forward mounting pin 231 from the coupler 201 in the event that the operator has missed the rear mounting pin 243 with the rear jaw 209 and over retracted the rail 235 relative the forward jaw 207, thus inadvertently or dangerously allowing untimely release of the forward mounting pin 231 from the forward jaw 207.

Figure 10:
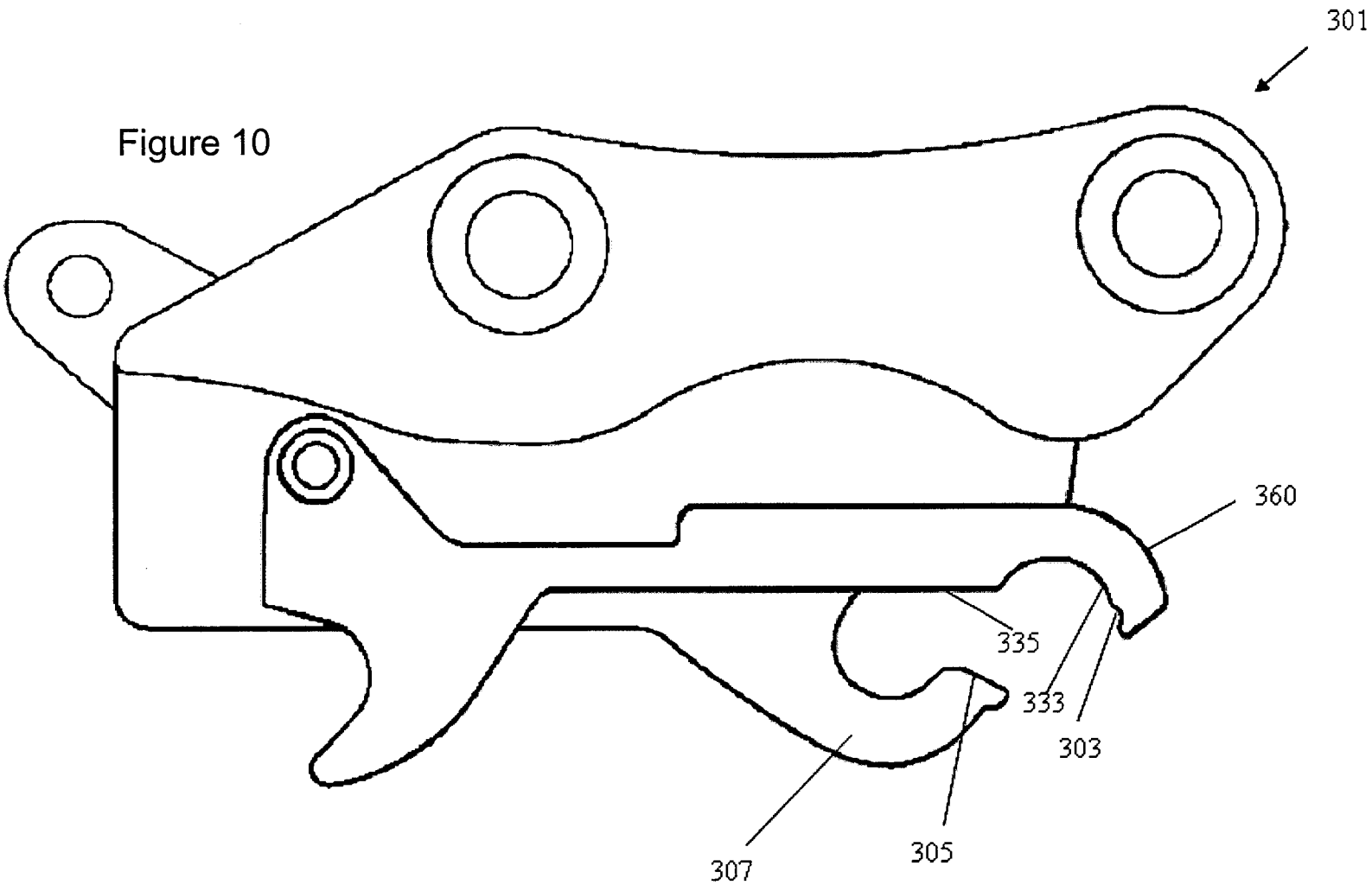
FIG. 10 shows a side view of another embodiment of a coupler with an alternative safety hook on the rail and an alternative jaw shape.
Figure 11:
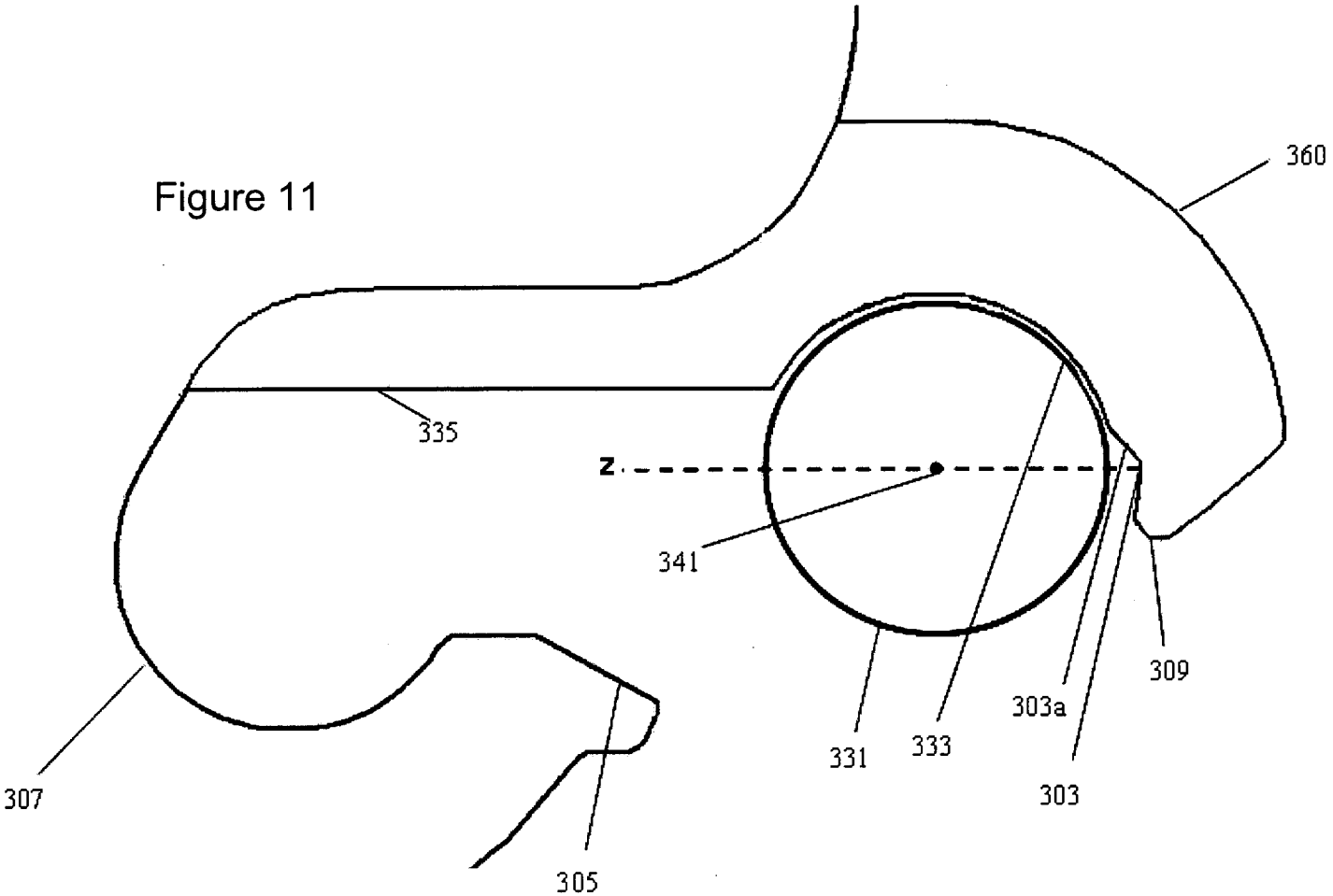
FIG. 11—shows a close-up side view of the safety hook and the jaw of the embodiment of the coupler shown in FIG. 10.

In another embodiment shown in FIGS. 10 and 11 a rail portion 335 of a coupler 301 has an alternative safety hook 360. The safety hook 360 is shaped to prevent retention of the mounting pin/formation 331 when it is being released from the coupler 301 when the coupler is in a vertical position. In particular, the safety hook 360 has a trough portion 303 positioned adjacent the free end of the safety hook 360 and on the inside concave surface 333 of the safety hook 360, that is the surface which faces the forward jaw 307. The trough portion 303 extends across the width of the safety hook 360.

In use, the trough portion 303 changes the geometry of the inside concave surface 333 of the safety hook 360 such that a mounting pin 331, pushing against the safety hook 360 through the force of gravity, is discouraged from settling or being trapped in the inside concave surface 333 of the safety hook 360, thereby encouraging it's release from the coupler 301. With particular reference to FIG. 11, the trough portion 303 is positioned to align (along line z) with the central rotational axis 341 of the mounting formation 331, which encourages release of the mounting pin 331. when it is pushed onto the inside concave surface 333 of the safety hook 360 through the action of gravity, for example when the coupler is orientated into a vertical position.

The trough portion 303 has a drop-off slope 303*a* which falls away from the general curvature of the concave surface 333. When the safety hook 360 is generally vertical, the centre of gravity of the mounting pin/bar 331 lies beyond the surface of the. concave surface 333 that is in contact with the mounting pin, because the drop-off slope 303*a*, and recess of the trough portion 303, have removed material from the surface. This causes the mounting pin 331 to drop off the concave surface 333.

The safety hook 360 has an end portion 309, which is a ridge positioned at the end of the safety hook 360. The end portion 309 allows a positive connection onto the mounting formation 331 when the safety hook 360 is being used to engage and guide the mounting formation 3 31 into the opening/recess defined by the jaw 307.

In another embodiment of the coupler 307, the end of the forward jaw 307 has a chamfered lead 305 into the opening/recess defined by the jaw 307. The chamfered lead 305 is defined by a substantially flat surface on the end of the jaw 307, which is angled away from the surface of the rail 335 to encourage and guide a mounting formation/pin to enter the mouth of the jaw 307, followed by a substantially flat surface which is substantially parallel to the rail 335. Thus, the chamfered lead 305 acts as a smooth guide surface for guiding the mounting formation into the opening/recess defined by the jaw 307. The chamfered lead 305 into the opening/recess defined by the jaw 307 prevents undesirable jamming or trapping during loading of a mounting formation into the opening/recess defined by the jaw 307.

What is claimed is:

1. A coupler having a body portion and a linearly movable rail, arranged to be moved by an actuator, the body portion comprising an open jaw arranged to receive a mounting formation of a tool, the rail having a first position in which. the rail is retracted relative to the open jaw and in which a mounting formation. can enter a recess defined by the jaw, and an advanced position in which the rail restricts the opening to the jaw, thereby arranged to trap, in use, the mounting formation in the recess, wherein the coupler further comprises a lip integral to the jaw which reduces a width of the opening of the jaw in comparison with an enlarged recess defined rearwards of the lip, wherein the rail comprises a substantially planar reaction surface arranged, in use, to contact the mounting formation.

2. The coupler according to claim 1, wherein the reaction surface of the rail is substantially parallel to the linear movement of the rail.

3. The coupler according to claim 1, wherein the lip has an inclined, or curved, surface disposed generally opposite to the reaction surface of the rail.

4. The coupler according to claim 1, wherein a rearwards wall of the jaw is inclined or curved towards the reaction surface of the rail.

5. The coupler according to claim 1, with a mounting formation retained in the coupler, wherein when the rail is in the advanced position, the shortest distance between the reaction surface of the rail and the lip is less than the diameter of the mounting formation.

6. The coupler according to claim 1, wherein the rail does not comprise a hook or projection which projects further from the rail in a direction across or partially across the opening of the jaw and intended to retain the mounting pin in the recess of the jaw.

7. The coupler according to claim 1, further comprises a safety hook extending from the rail, adapted in use to extend across the opening to the mounting formation receiving-aperture and retain the mounting formation.

8. The coupler according to claim 7, wherein the safety hook comprises a trough portion on an inner concave surface of the safety hook for Preventing, in use, unwanted retention of the mounting formation by the safety hook.

9. The coupler according to claim 7, wherein the safety hook comprises a recess surface, which is arranged in use to provide a wide enough gap between the end of the jaw and the recess surface to allow entry or exit of the mounting formation into the recess of the jaw, when the recess surface is aligned opposite the end of the jaw.

10. The coupler according to claim 1, wherein the rail portion comprises a second rear jaw for engaging a second mounting formation of the tool, the second rear jaw defining a recess provided with an opening.

11. The coupler according to claim 1, wherein the rear jaw faces in substantially the opposite direction to that of the opening of the jaw of the body portion open jaw.

12. The coupler according to claim 1, wherein the coupler comprises rail guides.

13. The coupler according to claim 12, wherein the rail is arranged, in use, to be maintained in position, when force is applied to the rail from the mounting formation, by friction between the rail and a coupler reaction surface on the coupler or by friction between the rail and a rail guide or by friction between the rail and the coupler reaction surface on the coupler and the rail guide.

14. The coupler according to claim 12, wherein the rail guides support the rail from at a position on the opposite side of the rail to the reaction surface of the rail.

15. The coupler according to claim 1, wherein the rail comprises a safety indication.

16. The coupler according to claim 1, wherein the opening in the jaw of the coupling, into which the mounting formation of the tool is received, is shaped so as to cause gravity to bias the mounting formation against the rail laterally of the rail when the coupler is in a particular orientation which could otherwise cause gravity to urge the rail to move to clear the opening of the jaw.

* * * * *